US005998127A

United States Patent [19]

Toya et al.

[11] Patent Number: 5,998,127

[45] Date of Patent: Dec. 7, 1999

[54] PHOTOTHERMOGRAPHIC MATERIALS

[75] Inventors: Ichizo Toya; Akihiro Hirano, both of Kanagawa, Japan

[73] Assignee: Fuji Photo Film Co., Ltd., Minami-ashigara, Japan

[21] Appl. No.: 09/052,945

[22] Filed: Apr. 1, 1998

[30] Foreign Application Priority Data

Apr. 1, 1997 [JP] Japan ..... 9-098361

[51] Int. Cl.[6] ..... G03L 1/498

[52] U.S. Cl. ..... 430/619; 430/617

[58] Field of Search ..... 430/619, 617

[56] References Cited

U.S. PATENT DOCUMENTS 5,891,615 4/1999 Winslow et al. ..... 430/603

OTHER PUBLICATIONS

D. H. Klosterboer, *Imaging Processes and Materials*, Thermally Processed Silver System, Neblette's Eighth Edition, Chapter 9, pp. 279–291 (1989).

*Primary Examiner*—Thorl Chea

*Attorney, Agent, or Firm*—Birch, Stewart, Kolasch & Birch, LLP

[57] ABSTRACT

A photothermographic material is provided wherein when it is exposed in an exposure dose of 30 $\mu J/cm^2$ and thermally developed at 120° C. for 20 seconds, the resulting spheres of influence have an average radius of 0.01–0.35 $\mu m$. The photothermographic material produces images undergoing minimal tone variations.

13 Claims, 1 Drawing Sheet

PHOTOTHERMOGRAPHIC MATERIALS

This invention relates to photothermographic materials and more particularly, to photothermographic materials capable of producing images which are minimized in tone variation due to the ambient humidity prior to thermal development.

BACKGROUND OF THE INVENTION

From the contemporary standpoints of environmental protection and space saving, it is strongly desired in the medical imaging field to reduce the quantity of spent solution. Needed in this regard is a technology relating to thermographic photosensitive materials for use in medical diagnosis and general photography which can be effectively exposed by means of laser image setters and laser imagers and produce distinct black-and-white images having a high resolution and sharpness. These thermographic photosensitive materials offer to the customer a simple thermographic system which eliminates a need for solution type chemical agents and is not detrimental to the environment.

Medical images must be consistently produced to the desired tone since the image tone has some influence on diagnosis. The photothermographic material, however, has the problem that depending on the humidity condition under which the material is kept prior to thermal development, the resulting image changes its tone. The method capable of overcoming this problem has never been available.

SUMMARY OF THE INVENTION

An object of the invention is to provide a photothermographic material capable of producing images undergoing minimal tone variations.

The present invention provides a photothermographic material wherein when it is exposed in an exposure dose of 30 $\mu J/cm^2$ and thermally developed at 120° C. for 20 seconds, the resulting spheres of influence have an average radius of 0.01 $\mu$m to 0.35 $\mu$m, preferably 0.02 $\mu$m to 0.25 $\mu$m.

In one preferred embodiment, the photothermographic material includes a photosensitive layer which has been formed by mixing a preformed photosensitive silver halide with a photo-insensitive organic silver salt so that the layer contains the photo-insensitive organic silver salt and the photosensitive silver halide. Preferably, the photosensitive silver halide has been chalcogen sensitized. The photo-insensitive organic silver salt preferably has a volume weighed mean grain diameter of 0.01 $\mu$m to 0.7 $\mu$m.

BRIEF DESCRIPTION OF THE DRAWINGS

The only figure, FIG. 1 schematically illustrates spheres of influence in a photosensitive layer.

DETAILED DESCRIPTION OF THE INVENTION

Figure 1:
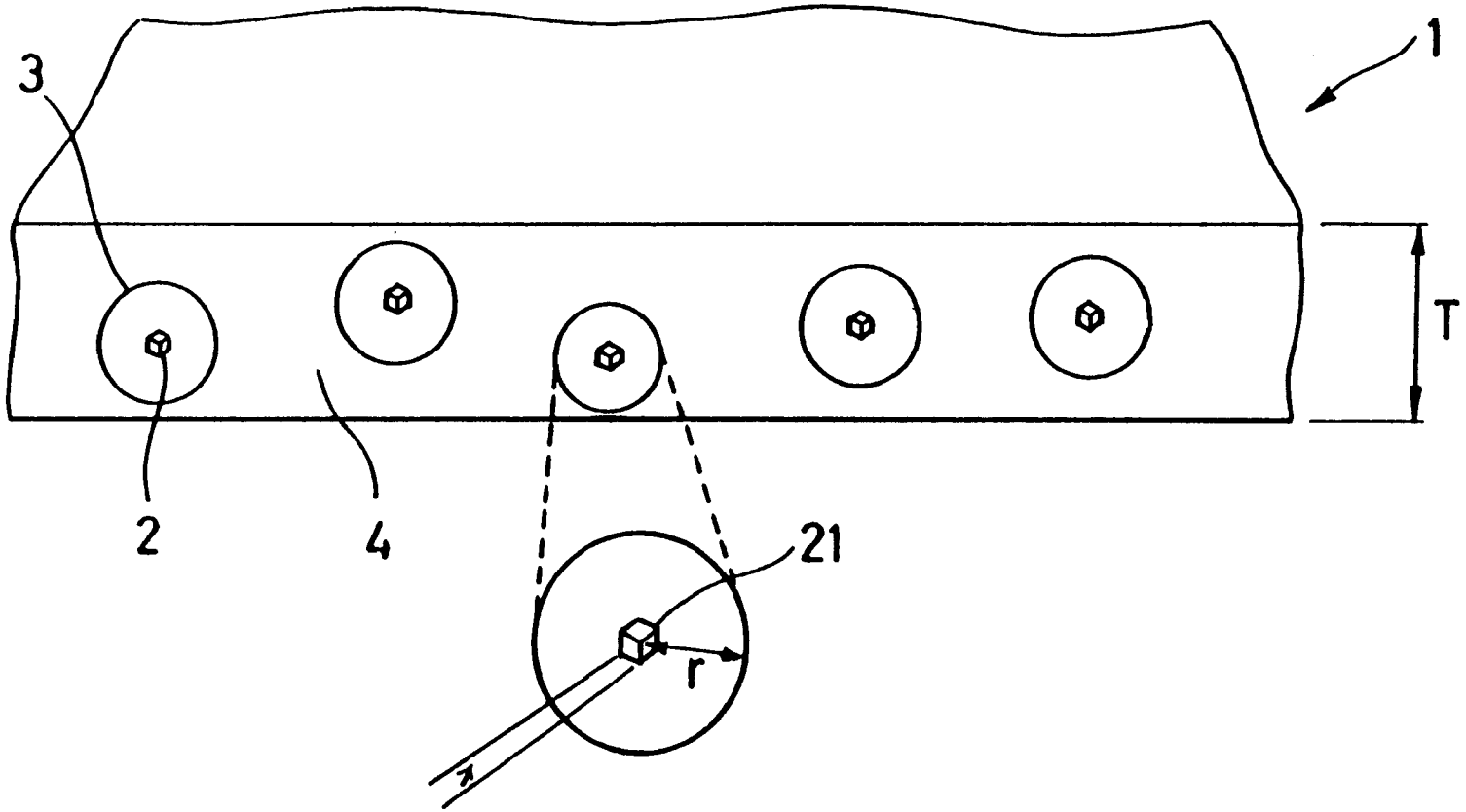

The photothermographic material of the invention is such that when it is exposed in an exposure dose of 30 $\mu J/cm^2$ and thermally developed at 120° C. for 20 seconds, the resulting spheres of influence have an average radius of 0.01 $\mu$m to 0.35 $\mu$m, preferably 0.02 $\mu$m to 0.25 $\mu$m.

The term "sphere of influence" used herein indicates the extent which is formed around developed silver resulting from the photosensitive silver halide, with the photo-insensitive silver salt being extinguished. This is schematically illustrated in FIG. 1. In a photosensitive layer or emulsion layer 1 of a certain thickness T (which is typically 0.5 to 50 $\mu$m) containing a photosensitive silver halide and a photo-insensitive organic silver salt, the silver halide has undergone photolysis upon exposure whereby a latent image or silver 21 is produced on a silver halide grain 2 as shown in FIG. 1. Upon subsequent thermal development, the silver catalyzes the reaction of the organic silver salt being reduced to silver so that a generally spherical zone 3 with the organic silver salt extinguished is formed around the developed silver or silver resulting from photolysis. This salt-depleted zone 3 is the sphere of influence. In the photosensitive layer 1, the remaining portion 4 other than the spheres of influence 3 is left undeveloped.

The average radius of spheres of influence is an average of equivalent radii (designated by r in FIG. 1) of circles equal to the projected areas of the spheres of influence.

Such spheres of influence can be detected by projecting a TEM (transmission electron microscope) image of a section of a photothermographic material which has been exposed and thermally developed under the above-defined conditions. Based on this sectional TEM image, the average radius of spheres of influence can be determined.

It is noted that the exposure dose is as measured at the surface of the photosensitive material. No particular limits are imposed on the humidity at which a photosensitive material sample is conditioned.

By restricting the average radius of spheres of influence to fall in the specific range, probably a relationship providing optimum catalysis of photosensitive silver halide on photo-insensitive organic silver salt is established independent of changes of the ambient humidity, whereby the tone variation of images due to humidity changes is prevented. If the average radius of spheres of influence is greater than 0.35 $\mu$m, noticeable tone variations occur. It is technically difficult to reduce the average radius of spheres of influence to less than 0.01 $\mu$m.

The spheres of influence as defined herein may be realized by suitable means, for example, by (1) controlling the amount of photosensitive silver halide relative to organic silver salt so as to fall within a specific range as will be described later, or (2) controlling the size of organic silver salt so as to fall within a specific range as will be described later.

The spheres of influence may overlap each other. Overlapping spheres of influence are preferred because the overlapping makes it easy to suppress the change of catalysis of photosensitive silver halide.

With respect to the sphere of influence, reference should be made to 'Thermally Processed Silver Systems' by D. H. Klosterboer in "Imaging Processes and Materials," Neblette's 8th Ed., Edited by Sturge et al., Van Nostrand Reinhold, New York, 1989.

To further enhance the benefits of the invention, to improve photographic characteristics such as speed, and to improve shelf stability, the method of separately preparing a photosensitive silver halide and a photo-insensitive organic silver salt, followed by mixing is preferred to the method of partially halogenating a photo-insensitive organic silver salt to form a photosensitive silver halide. The chemical sensitization of silver halide preferably includes chalcogen sensitization.

More particularly, it is preferred to form a photosensitive layer by mixing a preformed photosensitive silver halide with a photo-insensitive organic silver salt because the mutual dispersion of these two components becomes more uniform from a spatial aspect. The chalcogen sensitization desirably reduces the difference in sensitivity of photosensitive silver halide between grains.

Silver Halide

A method for forming the photosensitive silver halide is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention. The photosensitive silver halide should preferably have a smaller mean grain size for the purpose of minimizing white turbidity after image formation. Specifically, the grain size is preferably up to 0.20 μm, more preferably 0.01 μm to 0.15 μm, most preferably 0.02 μm to 0.12 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of photosensitive silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, mercury, and iron. The metal complexes may be used alone or in admixture of two or more complexes of a common metal or different metals. The metal complex is preferably contained in an amount of $1\times10^{-9}$ to $1\times10^{-2}$ mol, more preferably $1\times10^{-8}$ to $1\times10^{-3}$ mol per mol of silver. Illustrative metal complex structures are those described in JP-A 225449/1995. The cobalt and iron compounds are preferably hexacyano metal complexes while illustrative, non-limiting examples include ferricyanate, ferrocyanate, and hexacyanocobaltate ions. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are chalcogen sensitization methods including sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful.

The sulfur sensitizers used herein include sulfur compounds contained in gelatin as well as various sulfur compounds such as thiosulfates, thioureas, thiazoles, and rhodanines. Illustrative examples are described in U.S. Pat. Nos. 1,574,944, 2,278,947, 2,410,689, 2,728,668, 3,501,313, and 3,656,955. Preferred sulfur compounds are thiosulfate salts and thiourea compounds.

It is also useful to use selenium sensitizers. The selenium compounds include unstable selenium compounds and non-unstable selenium compounds. They are used by agitating the emulsion at elevated temperature, preferably above 40° C. for a certain time.

Preferred examples of the unstable selenium compound include those described in JP-B 15748/1969 and 13489/1968, Japanese Patent Application Nos. 130976/1990 and 229300/1990. Illustrative examples of the unstable selenium compound include isoselenocyanates (e.g., aliphatic isoselenocyanates such as allylisoselenocyanate), selenoureas, selenoketones, selenoamides, selenocarboxylic acids (e.g., 2-selenopropionic acid and 2-selenoacetic acid), selenioesters, diacylselenides (e.g., bis(3-chloro-2,6-dimethoxybenzoyl)selenide), selenophosphates, phosphineselenides (e.g., 2,3,4,5,6-pentafluorophenyldiphenylphosphineselenide), and colloidal metal selenium.

Although preferred types of unstable selenium compounds are described above, they are not limitative. With respect to the unstable selenium compounds as the sensitizer of photographic urea, it is generally understood by those skilled in the art that the structure of compound is not so important insofar as selenium is unstable and that an organic moiety of a selenium sensitizer molecule plays no role other than carrying selenium so that it may be present in an unstable form in the emulsion. Unstable selenium compounds of such a broad concept are advantageously used in the practice of the invention.

The non-unstable selenium compounds are described, for example, in JP-B 4553/1971, 34492/1977, and 34491/1977. Examples of the non-unstable selenium compound include selenious acid, potassium selenocyanate, selenazoles, quaternary salts of selenazoles, diarylselenides, diaryldiselenides, dialkylselenides, dialkyldiselenides, 2-selenazolidinediones, 2-selenooxazolidinethiones and derivatives thereof.

Also included are such sensitizers as polyoxyethylene compounds, polyoxypropylene compounds, and compounds having a quaternary ammonium group.

Exemplary tellurium sensitizing agents include diacyltellurides, bis(oxycarbonyl)tellurides, bis(carbamoyl)-tellurides, bis(oxycarbonyl)ditellurides, bis(carbamoyl)-ditellurides, compounds having a P═Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocycles, tellurocarbonyl compounds, inorganic tellurium compounds, and colloidal tellurium.

The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061.

Illustrative examples of the compound used in the reduction sensitization method include ascorbic acid, thiourea dioxide, stannous chloride, aminoiminomethanesulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

In the chalcogen sensitization preferred in the practice of the invention, the chalcogen sensitizer is preferably used in an amount of about $10^{-2}$ to about $10^{-7}$ mol per mol of silver forming the silver halide emulsion layer.

According to the invention, the photosensitive silver halide (calculated as silver) is preferably used in an amount of 0.01 to 0.5 mol, more preferably 0.02 to 0.3 mol, most preferably 0.03 to 0.25 mol per mol of the organic silver salt (calculated as silver). With respect to a method and conditions of admixing the separately prepared photosensitive-silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding the already prepared photosensitive-silver halide at any timing during preparation of an organic silver salt. Any desired mixing method may be used insofar as the benefits of the invention are fully achievable.

Organic Silver Salt

The photo-insensitive organic silver salt used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 30% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver arachidate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)-benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercapto-triazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such-as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methyl-benzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. No. 4,761,361 and 4,775,613.

The organic silver salt which can be used herein may take any desired shape although needle crystals having a minor axis and-a major axis are preferred. It is preferred that the organic silver salt be more dispersed. In this regard, the organic silver salt preferably has a volume weighed mean grain diameter of 0.01 to 0.7 $\mu$m, more preferably 0.05 to 0.4 $\mu$m. The grain size distribution of the organic silver salt is desirably monodisperse. A monodisperse distribution can be evaluated by determining a standard deviation of a volume weighed mean diameter of organic silver salt. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

In the practice of the invention, the organic silver salt is prepared into a solid microparticulate dispersion using a dispersant, in order to provide fine particles of small size and free of flocculation. A solid micro-particulate dispersion of the organic silver salt may be prepared by mechanically dispersing the salt in the presence of dispersing aids by well-known comminuting means such as ball mills, vibrating ball mills, planetary ball mills, sand mills, colloidal mills, jet mills, and roller mills.

The dispersant used in the preparation of a solid microparticulate dispersion of the organic silver salt may be selected from synthetic anionic polymers such as polyacrylic acid, copolymers of acrylic acid, copolymers of maleic acid, copolymers of maleic acid monoester, and copolymers of acryloylmethylpropanesulfonic acid; semi-synthetic anionic polymers such as carboxymethyl starch and carboxymethyl cellulose; anionic polymers such as alginic acid and pectic acid; anionic surfactants as described in JP-A 92716/1977 and WO 88/04794; the compounds described in Japanese Patent Application No. 350753/1995; well-known anionic, nonionic and cationic surfactants; and well-known polymers such as polyvinyl alcohol, polyvinyl pyrrolidone, carboxymethyl cellulose, hydroxypropyl cellulose, and hydroxypropylmethyl cellulose, as well as naturally occurring high molecular weight compounds such as gelatin.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The organic silver salt is used in any desired amount, preferably about 0.1 to 5 g per square meter of photosensitive material, more preferably about 1 to 3 g/m$^2$.

Reducing Agent

The reducing agent for the photo-insensitive silver csalt may be any of substances, preferably organic substances, that reduce silver ion into metallic silver. Conventional photographic developing agents such as Phenidone®, hydroquinone and catechol are useful although bisphenols and hindered phenols are preferred reducing agents. The reducing agent should preferably be contained in an amount of 2 to 30% by weight of the image forming layer.

A wide variety of reducing agents for photo-insensitive silver salts are disclosed in many patents. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2-bis-(hydroxymethyl)propionyl-β-phenylhydrazine with ascorbic acid; combinations of polyhydroxybenzenes with hydroxyl-amine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2-dihydroxy-1,1-binaphthyl, 6,6-dibromo-2,2-dihydroxy-1,1-binaphthyl, and bis(2-hydroxy-1-naphthyl)methane; combinations of bis-β-naphthols with 1,3-dihydroxybenzene derivatives such as 2,4-dihydroxybenzophenone and 2,4-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)-propane; ascorbic acid derivatives such as 1-ascorbyl palmitate and ascorbyl stearate; aldehydes and ketones such as benzil and diacetyl; 3-pyrazolidones and certain indane-1,3-diones.

The reducing agent may be contained as solid particles in the image forming layer or photosensitive layer or a layer adjacent-thereto. The preferred size of solid particles is in the visually unperceivable range, with an average diameter of up to 5 μm, especially up to 1 μm being preferred. The lower limit is not critical although it is usually about 0.001 μm.

Toner

A higher optical density is sometimes achieved when an additive known as a "toner" for improving images is contained. The toner is also sometimes advantageous in forming black silver images. The toner is preferably used in an amount of 0.1 to 50 mol %, especially 0.5 to 20 mol % based on the moles of silver on the image forming layer side. The toner may take the form of a precursor which is modified so as to exert its effective function only at the time of development.

For photothermographic materials using organic silver salts, a wide range of toners are disclosed, for example, in JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pat. Nos. 3,080,254, 3,446,648, 3,782,941, 4,123,282, 4,510,236, UKP 1,380,795, and Belgian Patent No. 841,910. Examples of the toner include phthalimide and N-hydroxyphthalimide; cyclic imides such as succinimide, pyrazoline-5-one, quinazolinone, 3-phenyl-2-pyrazolin-5-one, 1-phenylurazol, quinazoline and 2,4-thiazolizinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercapto-pyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)-naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-diazaoctane)-bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio- 2,4-oxazolidinedione; phthalazinone, phthalazinone derivatives or metal salts, or derivatives such as 4-(1-naphthyl)-phthalazinone, 6-chlorophthalazinone, 5,7-dimethoxyphthalazinone and 2,3-dihydro-1,4-phthalazinedione; combinations of phthalazinone with phthalic acid derivatives (e.g., phthalic acid, 4-methylphthalic acid, 4-nitrophthalic acid, and tetrachlorophthalic anhydride); phthalazine, phthalazine derivatives or metal salts, or derivatives such as 4-(1-naphthyl)phthlazine, 6-chlorophthalazine, 5,7-dimethoxyphthalazine and 2,3-dihydrophthlazine; combinations of phthalazine with phthalic acid derivatives (e.g., phthalic acid, 4-methylphthalic acid, 4-nitrophthalic acid, and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a, 5,6a-tetraazapentalene.

The toner may be added in any desired form, for example, as a solution, powder and solid microparticulate dispersion. The solid microparticulate dispersion of the toner is prepared by well-known finely dividing means such as ball mills, vibratory ball mills, sand mills, colloid mills, jet mills, and roller mills. Dispersing aids may be used in preparing the solid microparticulate dispersion.

Sensitizing Dye

There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and printing plate-forming cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for red light sources such as He-Ne lasers, red semiconductor lasers and LED.

For semiconductor laser light sources in the wavelength range of 750 to 1,400 nm, spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, UKP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituent group, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, UKP 1,467,638, and U.S. Pat. No. 5,281,515.

Also useful in the practice of the invention are dyes capable of forming the J-band as disclosed in U.S. Pat. Nos. 5,510,236, 3,871,887 (Example 5), JP-A 96131/1990 and 48753/1984.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been ascertained effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The amount of the sensitizing dye used may be an appropriate amount complying with sensitivity and fog although the preferred amount is about $10^{-6}$ to 1 mol, more preferably $10^{-4}$ to $10^{-1}$ mol per mol of the silver halide in the photosensitive layer.

Hydrazine

In the photothermographic material of the invention, hydrazine derivatives are often used as contrast enhancers. The hydrazine derivative is preferably selected from the compounds of formula (I) in Japanese Patent Application No. 47961/1994, more particularly compounds I-1 to I-53 disclosed therein.

Other hydrazine derivatives are also useful. Such examples include the compounds of the chemical formula [1] in JP-B 77138/1994, more specifically the compounds described on pages 3 and 4 of the same; the compounds of the general formula (1) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group forming an intermolecular hydrogen bond with the hydrogen atom of hydrazine in Japanese Patent Application No. 191007/1995, specifically the compounds of general formulae (A), (B), (C), (D), (E) and (F), more specifically compounds N-1 to N-30; and the compounds of the general formula (1) in Japanese Patent Application No. 191007/1995, more specifically compounds D-1 to D-55.

In the practice of the invention, the hydrazine nucleating agent may be used after it is dissolved in a suitable water-miscible organic solvent, for example, alcohols (e.g., methanol, ethanol, propanol and fluorinated alcohols), ketones (e.g., acetone and methyl ethyl ketone), dimethylformamide, dimethylsulfoxide, and methyl cellosolve.

Also, a well-known emulsifying dispersion method is used for dissolving the hydrazine nucleating agent with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine nucleating agent according to the invention may be added to a silver halide emulsion layer (photosensitive layer) on a support or another hydrophilic colloid layer on the same side as the silver halide emulsion layer, preferably the silver halide emulsion layer or a hydrophilic colloid layer disposed adjacent thereto.

The hydrazine nucleating agent is preferably used in an amount of 1 $\mu$mol to 10 mmol, more preferably 10 $\mu$mol to 5 mmol, most preferably 20 $\mu$mol to 5 mmol per mol of silver halide.

Binder

The emulsion layer used herein is based on a binder. Exemplary binders are naturally occurring polymers and synthetic resins, for example, gelatin, polyvinyl acetal, polyvinyl chloride, polyvinyl acetate, cellulose acetate, polyolefins, polyesters, polystyrene, polyacrylonitrile, polycarbonate, polyvinyl butyral, butyl ethyl cellulose, methacrylate copolymers, maleic anhydride ester copolymers, polystyrene and butadiene-styrene copolymers.

In the photosensitive layer, a polymer latex preferably constitutes more than 50% by weight of the entire binder. The "polymer latex" is a dispersion of a microparticulate water-insoluble hydrophobic polymer in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included.

With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of about 1 to 50,000 nm, more preferably about 5 to 1,000 nm. No particular limit is imposed on the particle size distribution of dispersed particles, and the dispersion may have either a wide particle size distribution or a monodisperse particle size distribution.

The polymer latex used herein may be either a latex of the conventional uniform structure or a latex of the so-called core/shell type. In the latter case, better results are sometimes obtained when the core and the shell have different glass transition temperatures.

The polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex;" Kobunshi Kankokai, 1970.

Polymers used in the polymer latex according to the invention include acrylic resins, vinyl acetate resins, polyester resins, polyurethane resins, rubbery resins, vinyl chloride resins, vinylidene chloride resins, polyolefin resins, and copolymers thereof.

The polymer may be linear or branched or crosslinked. The polymer may be either a homopolymer or a copolymer having two or more monomers polymerized together. The copolymer may be either a random copolymer or a block copolymer. The polymer preferably has a number average molecule weight Mn of about 5,000 to about 1,000,000, more preferably about 10,000 to about 100,000. Polymers with a too lower molecular weight would generally provide a low film strength after coating whereas polymers with a too higher molecular weight are difficult to form films.

The polymer of the polymer latex used herein should preferably have an equilibrium moisture content at 25° C. and RH 60% of 0.1 to 2% by weight, more preferably 0.2 to 1% by weight. With respect to the definition and measurement of equilibrium moisture content, reference should be made to "Polymer Engineering Series No. 14, Polymer Material Test Methods," Edited by Japanese Polymer Society, Chijin Shokan Publishing K.K., for example.

Illustrative examples of the polymer latex which can be used as the binder in the photosensitive layer of the photothermographic material of the invention include latices of methyl methacrylate/ethyl acrylate/methacrylic acid copolymers, latices of methyl methacrylate/2-ethylhexyl acrylate/styrene/acrylic acid copolymers, latices of styrene/butadiene/acrylic acid copolymers, latices of styrene/butadiene/divinyl benzene/methacrylic acid copolymers, latices of methyl methacrylate/vinyl chloride/acrylic acid copolymers, and latices of vinylidene chloride/ethyl acrylate/acrylonitrile/methacrylic acid copolymers.

These polymers or polymer latices are commercially available. Exemplary acrylic resins are Sebian A-4635, 46583 and 4601 (Daicell Chemical Industry K.K.) and Nipol LX811, 814, 820, 821 and 857 (Nippon Zeon K.K.). Exemplary polyester resins are FINETEX ES650, 611, 675, and 850 (Dai-Nihon Ink Chemical K.K.) and WD-size and WMS (Eastman Chemical Products, Inc.). Exemplary polyurethane resins are HYDRAN AP10, 20, 30 and 40 (Dai-Nihon Ink Chemical K.K.). Exemplary rubbery resins are LACSTAR 7310K, 3307B, 4700H and 7132C (Dai-Nihon Ink Chemical K.K.) and Nipol LX416, 410, 438C and 2507 (Nippon Zeon K.K.). Exemplary vinyl chloride resins are G351 and G576 (Nippon Zeon K.K.). Exemplary vinylidene chloride resins are L502 and L513 (Asahi Chemicals K.K.). Exemplary olefin resins are Chemipearl S120 and SA100 (Mitsui Petro-Chemical K.K.). Especially preferred among these polymer latices are latices of styrene-butadiene copolymers.

These polymers may be used alone or in admixture of two or more.

In the photosensitive layer according to the invention, the polymer latex described above is used in an amount of at least 50% by weight, especially at least 70% by weight, of the entire binder. In the photosensitive layer, a hydrophilic polymer may be added in an amount of less than 50% by weight of the entire binder. Such hydrophilic polymers are gelatin, polyvinyl alcohol, methyl cellulose, hydroxypropyl cellulose, carboxymethyl cellulose, and hydroxypropyl cellulose. The amount of the hydrophilic polymer added is preferably less than 30% by weight of the entire binder in the photosensitive layer.

The photosensitive layer according to the invention is preferably formed by applying an aqueous coating solution followed by drying. By the term "aqueous", it is meant that water accounts for at least 30% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformamide, and ethyl acetate. Exemplary solvent compositions include water, a 90/10 or 70/30 mixture of water/methanol, a 90/10 mixture of water/ethanol, a 90/10 mixture of water/isopropanol, a 95/5 mixture of water/dimethylformamide, a 80/15/5 or 90/5/5 mixture of water/methanol/dimethylformamide, all expressed in a weight ratio.

In the photosensitive layer according to the invention, the total amount of binder is preferably 0.2 to 30 g/m$^2$, more preferably 1 to 15 g/m$^2$ per layer. Each photosensitive layer preferably has a thickness of 0.5 to 50 $\mu$m, more preferably 1 to 30 $\mu$m.

In the photosensitive layer according to the invention, reducing agents, organic silver salts, toners, antifoggants and other ingredients are added if desired. Additionally, dyes for adjusting tone, crosslinking agents for crosslinking, surfactants for ease of application, and other addenda may be added to the photosensitive layer.

The photothermographic material of the invention may further include another photosensitive layer other than "the photosensitive layer of the invention," that is, another photosensitive layer which does not satisfy the requirement of the invention. The binder, coating solution solvent and other components of the other photosensitive layer are not critical.

Photo-insensitive Layer

In addition to the photosensitive layer(s), the photothermographic material of the invention often includes a photo-insensitive layer(s) which is typically a surface protective layer.

Any desired binder may be used in the surface protective layer. Use may be made of such polymers as gelatin, polyvinyl alcohol (PVA), casein, agar, gum arabic, hydroxyethyl cellulose, cellulose acetate, cellulose acetate butyrate, polyvinyl chloride, polymethacrylic acid, polyvinylidene chloride, and polyvinyl acetate. Of these, hydrophilic polymers are preferred, with gelatin being especially preferred. The gelatin may be any of limetreated gelatin, acid-treated gelatin and otherwise treated gelatin. Gelatin derivatives are also useful. A latex of ethyl acrylate polymer, for example, may be added to the hydrophilic polymer as the binder of the surface protective layer.

Each photo-insensitive layer preferably has a thickness of 0.1 to 10 $\mu$m, more preferably 0.5 to 5 $\mu$m.

The photo-insensitive layer is preferably formed by coating an aqueous coating solution and drying the coating as previously mentioned.

The surface protective layer contains a lubricant. Useful lubricants include silicon compounds as disclosed in JP-A 117414/1975, 140341/1985, 140342/1985, 191240/1985, 4649/1984, U.S. Pat. No. 4,404,276, German Patent Nos. 2509534 and 1938959; esters as disclosed in JP-A 86540/1983, 37217/1976, 159221/1979, 90633/1983, and 141623/

1976; carboxylic amide compounds as disclosed in JP-A 79435/1980; fluorine compounds as disclosed in JP-A 19647/1988, and higher fatty acids and salts thereof as disclosed in British Patent No. 1263722.

The lubricant is preferably added in an amount of 0.2 to 500 mg/m$^2$, more preferably 1 to 300 mg/m$^2$.

The lubricant is preferably added such that the photothermographic material of the invention on the surface may have a coefficient of static friction of 0.1 to 0.4 and a coefficient of dynamic friction of 0.1 to 0.3. Since the sliding between an outer surface on the photosensitive layer-bearing side and an opposite outer surface (or back surface) becomes a matter of some concern when sheets of the photothermographic material of the invention are laid one on the other, it is preferred that a coefficient of static friction of 0.1 to 0.4 and a coefficient of dynamic friction of 0.1 to 0.3 be available between these two surfaces. The coefficients of friction can be determined by well-known techniques.

In the surface protective layer, any of organic silver salts, reducing agents therefor, toners, antifoggants, matte agents, dyestuffs, fluorinated surfactants and other addenda may be added if desired.

The matte agents used in the surface protective layer are preferably microparticulates of polystyrene, polymethyl methacrylate and silica. The particulate shape is not critical although spherical microparticulates are preferred. The matte agent typically has a particle size of about 0.2 to 20 $\mu$m, preferably about 0.5 to 10 $\mu$m. The amount of matte agent added varies with the layer arrangement, layer thickness and intended application of the photothermographic material although it is preferably about 10 to 200 mg/m$^2$, more preferably about 20 to 100 mg/m$^2$ as expressed by a coverage per square meters of the photosensitive material.

Also preferably, the surface protective layer is crosslinked with a crosslinking agent. The crosslinking agent used herein is not critical and may be any of well-known crosslinking agents such as epoxy compounds, isocyanate compounds, melamine compounds, and phenol compounds. As the isocyanate compounds, blocked isocyanates may also be used. Where gelatin is the binder in the surface protective layer, crosslinking agents such as active halogen compounds and vinyl sulfone compounds are preferred. Where polyvinyl alcohol is the binder in the surface protective layer, boric acid is also a preferred crosslinking agent. With respect to the crosslinking agent, reference should be made to Yamashita, "Crosslinking Agent Handbook," Taisei K. K., 1981, for example.

Back Layer

The photothermographic material of the invention may be provided with a back or backing layer on a surface of a support opposite to one surface where the photosensitive layer is coated.

The back layer is based on a binder which is not critical and may be selected from those binders described in conjunction with the photosensitive layer and photo-insensitive layers. As the binder, preference is made on polymer latices as described in conjunction with the photosensitive layer, especially latices of polymers having an equilibrium moisture content of up to 2 wt % at 25° C. and RH 60%. The back layer is preferably formed by coating an aqueous coating solution as previously described, followed by drying.

The back layer preferably exhibits a maximum absorbance of 0.3 to 2, more preferably 0.5 to 2 in the predetermined wavelength range and an absorbance of 0.001 to less than 0.5 in the visible range after processing. Further preferably, the back layer has an optical density of 0.001 to less than 0.3.

In the back layer, there may be added surfactants, crosslinking agents and other addenda if desired. A backside resistive heating layer as described in U.S. Pat. Nos. 4,460,681 and 4,374,921 may also be provided.

The back layer preferably has a thickness of about 0.1 to 20 $\mu$m, more preferably about 0.5 to 10 $\mu$m.

In the practice of the invention, the backing layer should preferably have a degree of matte as expressed by a Bekk smoothness of 10 to 250 seconds, more preferably 50 to 180 seconds.

The photosensitive material of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

According to the invention, the photosensitive and photo-insensitive layers may be formed on a variety of supports. Typical supports include poly(ethylene terephthalate) film, polyethylene naphthalate film, cellulose nitrate film, cellulose ester film, poly(vinyl acetal) film, and polycarbonate film as well as glass, paper, metals, etc. Of these, biaxially oriented polyethylene terephthalate is preferred because of strength, dimensional stability and chemical resistance. The support may be dyed or subbed if desired.

A method for producing color images using the photothermographic material of the invention is as described in JP-A 13295/1995, page 10, left column, line 43 to page 11, left column, line 40. Stabilizers for color dye images are exemplified in UKP 1,326,889, U.S. Pat. Nos. 3,432,300, 3,698,909, 3,574,627, 3,573,050, 3,764,337, and 4,042,394.

In the practice of the invention, layers of the photothermographic material can be formed by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and UKP 837,095.

In the photothermographic material of the invention, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate member.

The photosensitive material of the invention may be developed by any desired method although it is generally developed by heating after imagewise exposure. The preferred developing temperature is about 80 to 250° C., more preferably 100 to 140° C., further preferably 110 to 130° C., most preferably 115 to 125° C. The preferred developing time is about 2 to 60 seconds, more preferably about 10 to 30 seconds, most preferably about 15 to 25 seconds.

Any desired technique may be used for the exposure of the photothermographic material of the invention. The preferred light source for exposure is a laser, for example, a gas laser, YAG laser, dye laser or semiconductor laser. A semiconductor laser combined with a second harmonic generating device is also useful.

Upon exposure, the photosensitive material of the invention tends to generate interference fringes due to low haze. Known techniques for preventing generation of interference fringes are a technique of obliquely directing laser light to a photosensitive material as disclosed in JP-A 113548/1993 and the utilization of a multi-mode laser as disclosed in WO 95/31754. These techniques are preferably used herein.

EXAMPLE

Examples of the present invention are given below by way of illustration and not by way of limitation.

Example 1

Silver Halide Grains A

In 700 ml of water were dissolved 22 grams of phthalated gelatin and 27 mg of potassium bromide. The solution was adjusted to pH 5.0 at a temperature of 40° C. To the solution, 159 ml of an aqueous solution containing 18.6 grams of silver nitrate and an aqueous solution containing potassium bromide and potassium iodide in a molar ratio of 92:8 were added over 20 minutes by the controlled double jet method while maintaining the solution at pAg 7.7. Then, 476 ml of an aqueous solution containing 55.4 grams of silver nitrate and an aqueous solution containing 8 μmol/liter of dipotassium hexachloroiridate and 1 mol/liter of potassium bromide were added over 30 minutes by the controlled double jet method while maintaining the solution at pAg 7.7. Then the pH of the solution was lowered to cause flocculation and sedimentation for desalting. The solution was adjusted to pH 5.9 and pAg 8.0 by adding 0.1 gram of phenoxyethanol. There were obtained cubic grains having a silver iodide content of 8 mol % in the core and 2 mol % on the average, a mean grain size of 0.07 μm, a coefficient of variation of the projected area diameter of 9%, and a (100) face proportion of 89%.

The thus obtained silver halide grains were heated at 60° C., to which 85 μmol of sodium thiosulfate, 5 μmol of 2,3,4,5,6-pentafluorophenyldiphenylphosphine selenide, 2 μmol of chloroauric acid and 230 μmol of thiocyanic acid were added per mol of silver. The solution was ripened for 120 minutes. Then with stirring and the temperature adjusted to 50° C., $5\times10^{-4}$ mol of Sensitizing Dye A and $2\times10^{-4}$ mol of Sensitizing Dye B were added to the solution per mol of the silver halide. Potassium iodide was added in an amount of 3.5 mol % based on the silver halide to the solution, which was agitated for 30 minutes and then quenched to 30° C., completing the preparation of an emulsion of silver halide grains A.

Silver Halide Grains B

An emulsion of silver halide grains B was prepared as was the emulsion of silver halide grains A except that the amount of potassium bromide was adjusted such that the silver halide grains might have a mean grain size of 0.05 μm.

Organic Acid Silver Microcrystalline Dispersion A

A mixture of 40 grams of behenic acid, 7.3 grams of stearic acid, and 500 ml of water was stirred for 15 minutes at 90° C., 187 ml of 1N NaOH was added over 15 minutes, and 61 ml of an aqueous solution of 1N nitric acid was added to the solution which was cooled to 50° C. Then 124 ml of an aqueous solution of 1N silver nitrate was added over 2 minutes to the solution which was continually agitated for 30 minutes. Thereafter, the solids were separated by suction filtration and washed with water until the water filtrate reached a conductivity of 30 μS/cm. The thus obtained solids were handled as a wet cake without drying. To 34.8 g as dry solids of the wet cake were added 12 grams of polyvinyl alcohol and 150 ml of water. They were thoroughly mixed to form a slurry. A vessel was charged with the slurry together with 840 grams of zirconia beads having a mean diameter of 0.5 mm. A dispersing machine (¼ G Sand Grinder Mill by Imex K.K.) was operated for one hour for dispersion, completing the preparation of a microcrystalline dispersion of organic acid silver grains having a volume weighed mean grain diameter of 1.5 μm as measured by Master Sizer X (Malvern Instruments Ltd.).

Organic Acid Silver Microcrystalline Dispersions B and C

The dispersion time was extended, yielding a dispersion B having a volume weighed mean grain diameter of 0.6 μm and a dispersion C having a volume weighed mean grain diameter of 0.3 μm.

Solid Particle Dispersions of Chemical Addenda

Solid particle dispersions of tetrachlorophthalic acid, 4-methylphthalic acid, 1,1-bis(2-hydroxy-3,5-dimethylphenyl)- 3,5,5-trimethylhexane, phthalazine, and tribromomethylphenylsulfone were prepared.

To tetrachlorophthalic acid were added 0.81 grams of hydroxypropylmethyl cellulose and 94.2 ml of water. They were thoroughly agitated to form a slurry, which was allowed to stand for 10 hours. A vessel was charged with the slurry together with 100 ml of zirconia beads having a mean diameter of 0.5 mm. A dispersing machine as above was operated for 5 hours for dispersion, obtaining a solid particle dispersion of tetrachlorophthalic acid in which particles with a diameter of up to 1.0 μm accounted for 70% by weight.

Sensitizing Dye A

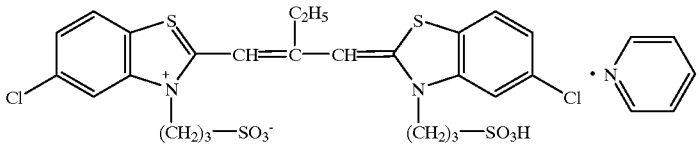

Sensitizing Dye B

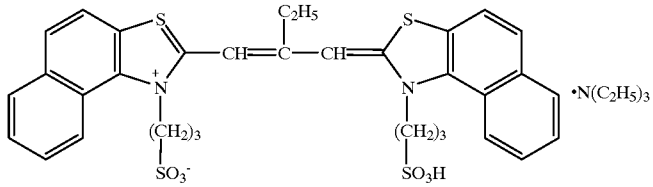

Solid particle dispersions of the remaining chemical addenda were similarly prepared by properly changing the amount of dispersant and the dispersion time to achieve a desired mean particle size.

Emulsion Layer Coating Solution

An emulsion layer coating solution was prepared by mixing the following components.

| | |
|---|---|
| LACSTAR 3307B SBR latex | 430 g |
| Tetrachlorophthalic acid | 5 g |
| 1,1-bis(2-hydroxy-3,5-dimethylphenyl)-3,5,5-trimethylhexane | 98 g |
| Phthalazine | 9.2 g |
| Tribromomethylphenylsulfone | 12 g |
| 4-methylphthalic acid | 7 g |
| Silver halide grains | Table 1 |
| Organic acid silver microcrystalline dispersion | 1 mol as Ag |

It is noted that LACSTAR 3307B is a styrene-butadiene rubber (SBR) latex commercially available from Dai-Nihon Ink Chemical Industry K.K. wherein the polymer has an equilibrium moisture content of 0.6 wt % at 25° C. and RH 60% and the dispersed particles have a mean particle diameter of 0.1 to 0.15 μm.

Emulsion Surface Protective Layer Coating Solution

A surface protective layer coating solution was prepared by mixing 10 grams of inert gelatin with 0.26 gram of Surfactant A, 0.09 gram of Surfactant B, 50 mg/m$^2$ of a matte agent (silica) with a mean particle size of 5 μm, 0.3 gram of 1,2-bis(vinylsulfonylacetamido)ethane, and 64 grams of water.

Surfactant A

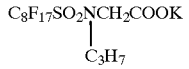

Surfactant B

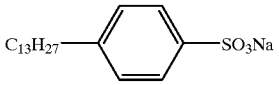

Decolorizable Dye Dispersion

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was volatilized off for solvent removal purpose. Dilution with water yielded a decolorizable dye dispersion.

Compound 1

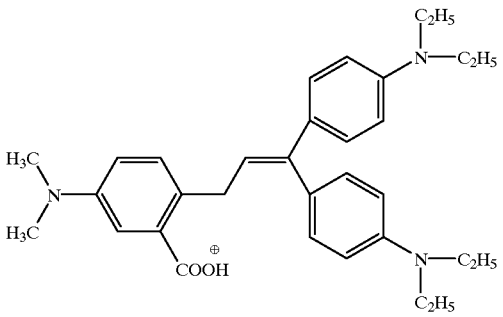

-continued

Compound 2

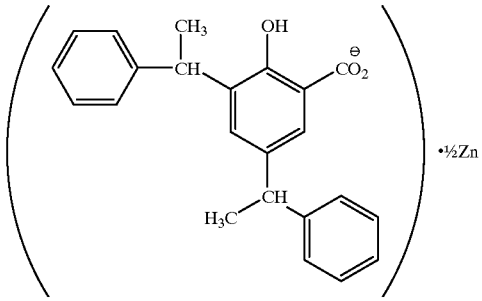

Back Surface Coating Solution

A back surface coating solution was prepared by adding 50 grams of the decolorizable dye dispersion, 20 grams of Compound 3, 250 grams of water, and a matte agent (of the same type and amount as used in the surface protective layer) to 30 grams of SBR latex (the same as used in the emulsion layer).

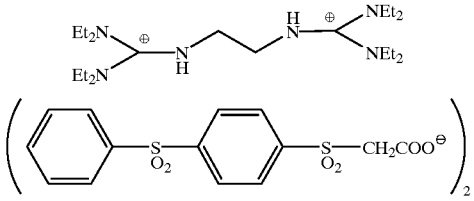

Coated Samples

The emulsion layer coating solution prepared above was coated onto a polyethylene terephthalate support of 160 μm thick tinted with a blue dyestuff so as to give a silver coverage of 1.9 g/m$^2$. The emulsion surface protective layer coating solution was then coated onto the emulsion coating so as to give a gelatin coverage of 1.8 g/m$^2$. After drying, the back surface coating solution was coated onto the surface of the support opposite to the emulsion layer so as to give an optical density of 0.7 at 660 nm.

Coated film samples prepared in this way were measured for the average radius of spheres of influence.

Measurement of Sphere-of-Influence Average Radius

The coated film samples were left to stand for 3 hours at 25° C. and RH 60%, exposed to a 660-nm beam from a semiconductor laser at an angle of 20° relative to a normal to the film surface in a dose of 30 μJ/cm$^2$ as measured at the film surface, and heat developed at 120° C. for 20 seconds. Ultra-thin pieces were sectioned from the samples for TEM observation. Based on the projected areas, radii of the equivalent circles were calculated, from which an average radius was determined.

The coated film samples were also evaluated for a change of tone with a change of humidity in the ambient atmosphere.

Silver Tone Change

The coated film samples were left to stand under conditions (1) including 25° C., RH 20% and 3 hours or conditions (2) including 25° C., RH 70% and 3 hours, exposed to a 660-nm beam from a semiconductor laser at an angle of 20° relative to a normal to the film surface, and heat developed at 120° C. for 20 seconds. The developed samples were visually observed for silver tone and rated according to the following criteria.

Exc.: little tone change
Good: some, but practically acceptable, tone changes
Poor: Unacceptable tone changes
The results are shown in Table 1.

TABLE 1

| Sample No. | Organic silver salt micro-crystalline dispersion | Silver halide particles (mol of Ag) | Sphere-of-influence average radius ($\mu$m) | Silver tone change |
|---|---|---|---|---|
| 1* | A | A (0.1) | 0.49 | Poor |
| 2 | B | A (0.1) | 0.32 | Good |
| 3 | C | A (0.1) | 0.21 | Exc. |
| 4 | A | A (0.27) | 0.35 | Good |
| 5 | B | A (0.27) | 0.23 | Exc. |
| 6 | C | A (0.27) | 0.18 | Exc. |
| 7 | A | B (0.1) | 0.32 | Good |
| 8 | B | B (0.1) | 0.20 | Exc. |
| 9 | C | B (0.1) | 0.14 | Exc. |
| 10 | A | B (0.27) | 0.30 | Good |
| 11 | B | B (0.27) | 0.17 | Exc. |
| 12 | C | B (0.27) | 0.11 | Exc. |

*outside the scope of the invention
Note: The amount of silver halide particles added is expressed by a molar amount of silver per mol of silver in the organic silver salt.

It is evident from Table 1 that the samples within the scope of the invention are excellent against a tone change due to humidity in the ambient atmosphere. The samples within the scope of the invention were found satisfactory with respect to photographic characteristics and shelf stability, indicating improved utility in practical application.

Example 2

Sample Nos. 8A and 8B were prepared by the same procedure as sample No. 8 in Example 1 except that $4.6\times10^{-3}$ mol of Compound A and $1.4\times10^{-2}$ mol of Compound B were added per mol of silver. They were similarly examined. The results are shown in Table 2.

Compound A

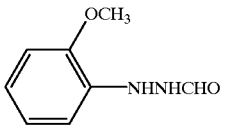

Compound B

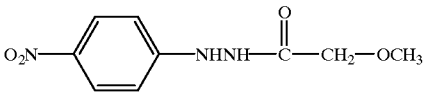

TABLE 2

| Sample No. | Sphere-of-influence average radius ($\mu$m) | Silver tone change |
|---|---|---|
| 8A | 0.06 | Exc. |
| 8B | 0.09 | Exc. |

It is evident from Table 2 that sample Nos. 8A and 8B are excellent against a tone change due to humidity in the ambient atmosphere. These samples were found satisfactory with respect to photographic characteristics and shelf stability, indicating that they were high contrast photosensitive materials finding improved utility in practical application.

There have been described photothermographic materials which are effective for restraining images from undergoing tone changes due to ambient humidity changes.

Japanese Patent Application No. 98361/1997 is incorporated herein by reference.

Reasonable modifications and variations are possible from the foregoing disclosure without departing from either the spirit or scope of the present invention as defined by the claims.

We claim:

1. A photothermographic material comprising a photosensitive layer which has been formed by mixing a preformed photosensitive silver halide with a photo-insensitive organic silver salt so that the layer contains the photo-insensitive organic silver salt and the photosensitive silver halide, wherein when said photothermographic material is exposed in an exposure dose of 30 $\mu$J/cm$^2$ and thermally developed at 120° C. for 20 seconds, the resulting spheres of influence have an average radius of 0.01 $\mu$m to 0.35 $\mu$m.

2. The photothermographic material of claim 1, wherein said photosensitive silver halide has been chalcogen sensitized.

3. The photothermographic material of claim 1, wherein said spheres of influence have an average radius of 0.02 $\mu$m to 0.25 $\mu$m.

4. The photothermographic material of claim 1, wherein said photo-insensitive organic silver salt has a volume weighed mean grain diameter of 0.01 $\mu$m to 0.7 $\mu$m.

5. The photothermographic material of claim 1, wherein an organic silver salt has a volume weighed mean grain diameter of 0.05 to 0.4 $\mu$m.

6. The photothermographic material of claim 1, wherein said photosensitive silver halide is present in an amount of 0.01 to 0.5 mol per mol of said photo-insensitive organic silver salt.

7. The photothermographic material of claim 1, wherein said photosensitive silver halide is present in an amount of 0.02 to 0.3 mol per mol of said photo-insensitive organic silver salt.

8. The photothermographic material of claim 7 wherein said photosensitive silver halide is used in an amount of 0.03 to 0.25 mol per mol of said photo-insensitive organic silver salt.

9. The photothermographic material of claim 1, wherein said photo-insensitive organic silver salt is contained in an amount of 0.1 to 5 g/m$^2$ of said photothermographic material.

10. The photothermographic material of claim 1 further containing reducing agent.

11. The photothermographic material of claim 10 wherein said reducing agent is contained in an amount of 2 to 30% by weight of an image forming layer.

12. The photothermographic material of claim 1 further containing binder wherein the total amount of said binder in said photosensitive layer is 0.2 to 30 g/m$^2$ per layer.

13. A photothermographic material comprising a photosensitive layer which has been formed by mixing a preformed photosensitive silver halide with a photo-insensitive organic silver salt so that the layer contains the photo-insensitive organic silver salt and the photosensitive silver halide, wherein when said photothermographic material is exposed in an exposure dose of 30 $\mu$J/cm$^2$ and thermally developed at 120° C. for 20 seconds, the resulting spheres of influence have an average radius of 0.01 $\mu$m to 0.35 $\mu$m, said photothermographic material further containing reducing agent and binder, wherein the silver halide emulsion and the light insensitive organic silver salt are incorporated into the same layer.

* * * * *